US009212321B2

(12) United States Patent
Timken et al.

(10) Patent No.: US 9,212,321 B2
(45) Date of Patent: Dec. 15, 2015

(54) PROCESS FOR RECYCLING HYDROGEN HALIDE TO A REACTOR COMPRISING AN IONIC LIQUID

(75) Inventors: Hye-Kyung Timken, Albany, CA (US); Christine Phillips, Pleasant Hill, CA (US); Robert F. Cleverdon, Walnut Creek, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 1491 days.

(21) Appl. No.: 12/650,826

(22) Filed: Dec. 31, 2009

(65) Prior Publication Data

US 2011/0155640 A1 Jun. 30, 2011

(51) Int. Cl.
*C10G 31/06* (2006.01)
*C10G 7/00* (2006.01)

(52) U.S. Cl.
CPC ..... *C10G 7/00* (2013.01); *C10G 2300/201* (2013.01)

(58) Field of Classification Search
None
See application file for complete search history.

(56) References Cited

U.S. PATENT DOCUMENTS

| | | | | |
|---|---|---|---|---|
| 2,397,820 | A * | 4/1946 | Thompson et al. | 585/313 |
| 2,406,868 | A * | 9/1946 | Tongberg et al. | 585/745 |
| 2,983,774 | A * | 5/1961 | Thompson | 585/372 |
| 3,671,601 | A * | 6/1972 | Sanderson et al. | 585/451 |
| 3,873,635 | A * | 3/1975 | Prescott et al. | 585/702 |
| 5,565,617 | A | 10/1996 | Schmidt et al. | |
| 5,750,455 | A * | 5/1998 | Chauvin et al. | 502/164 |
| 7,432,408 | B2 * | 10/2008 | Timken et al. | 585/709 |
| 7,432,409 | B2 | 10/2008 | Elomari et al. | |
| 7,495,144 | B2 | 2/2009 | Elomari | |
| 7,538,256 | B2 | 5/2009 | Driver et al. | |
| 2005/0010076 | A1 | 1/2005 | Wasserscheid et al. | |
| 2008/0015369 | A1 | 1/2008 | Kruper, Jr. et al. | |
| 2010/0025292 | A1 | 2/2010 | Hommeltoft et al. | |
| 2010/0065476 | A1 | 3/2010 | Hommeltoft et al. | |

FOREIGN PATENT DOCUMENTS

FR 2862059 B1 5/2007

OTHER PUBLICATIONS

K. Qiao and Y. Deng, Alkylations of Benzene in Room Temperature Ionic Liquids Modified with HCl, 171 J. Mol. Catal. A: Chem. 81-84 (2001).*

(Continued)

*Primary Examiner* — Randy Boyer
(74) *Attorney, Agent, or Firm* — Susan M. Abernathy

(57) ABSTRACT

A process for hydrocarbon conversion, comprising: a) stripping or distilling a hydrocarbon effluent from a reactor comprising an ionic liquid catalyst having: a metal halide, and a hydrogen halide or an organic halide into a first and second fraction, and b) recycling at least a portion of the first fraction comprising at least 5 wt % and less than 95 wt % of the hydrogen halide to the reactor. A process comprising: a) stripping or distilling a hydrocarbon effluent from a reactor comprising an ionic liquid catalyst into a first fraction having at least 5 wt % of hydrogen halide and a second fraction having less than 25 wppm hydrogen halide; and b) recycling at least a portion of the first fraction to the reactor to improve the selectivity of products. A process comprising recycling of the catalyst, the first fraction, and a portion of the second fraction that is an isoparaffin to the reactor.

18 Claims, 2 Drawing Sheets

(56) References Cited

OTHER PUBLICATIONS

V. A. Ksenofontov et al., Isomerization of Cyclic Hydrocarbons Mediated by an AlCl3-Based Ionic Liquid as Catalyst, 80 React. Kinet. Catal. Lett. 329-335 (2003).*

R. Zhang et al., Isomerization of n-Pentane Catalyzed by Acidic Chloroaluminate Ionic Liquids, 47 Ind. Eng. Chem. Res. 8205-8210 (2008).*

* cited by examiner

PROCESS FOR RECYCLING HYDROGEN HALIDE TO A REACTOR COMPRISING AN IONIC LIQUID

This application is related to a co-filed application, titled "A PROCESS FOR MAKING PRODUCTS WITH LOW HYDROGEN HALIDE," fully incorporated herein.

FIELD OF THE INVENTION

This application is directed to improved processes for hydrocarbon conversion by recycling a stripped or distilled effluent containing hydrogen halide to a reactor.

SUMMARY OF THE INVENTION

This application provides a process for hydrocarbon conversion, comprising:

a) stripping or distilling a hydrocarbon effluent from a reactor comprising an ionic liquid catalyst having: a metal halide, and a hydrogen halide or an organic halide into:

i. a first fraction having an increased amount of a hydrogen halide, and ii. a second fraction having a reduced amount of the hydrogen halide; and b) recycling at least a portion of the first fraction, wherein the at least a portion comprises at least 5 wt % and less than 95 wt % of the hydrogen halide, to the reactor.

This application also provides a process for hydrocarbon conversion, comprising:

a) stripping or distilling a hydrocarbon effluent from a reactor comprising an ionic liquid catalyst into a first fraction having at least 5 wt % of a hydrogen halide and a second fraction having less than 25 wppm of the hydrogen halide; and b) recycling at least a portion of the first fraction to the reactor to improve the selectivity of the products from the reactor to alkylate gasoline or middle distillate.

This application also provides a process for hydrocarbon conversion, comprising:

a) separating an effluent from a reactor comprising an ionic liquid catalyst, a metal halide, and a hydrogen halide or an organic halide into a hydrocarbon phase and a catalyst phase;

b) recycling at least a portion of the catalyst phase back to the reactor;

c) stripping or distilling the hydrocarbon phase into a first fraction having greater than 5 wt % of the hydrogen halide and a second fraction having less than 25 wppm of the hydrogen halide; and d) recycling at least a portion of the first fraction, wherein the at least a portion has greater than 5 wt % of the hydrogen halide, to the reactor; and e) recycling a portion of the second fraction, that comprises one or more isoparaffins, to the reactor.

DETAILED DESCRIPTION OF THE INVENTION

Figure 1:
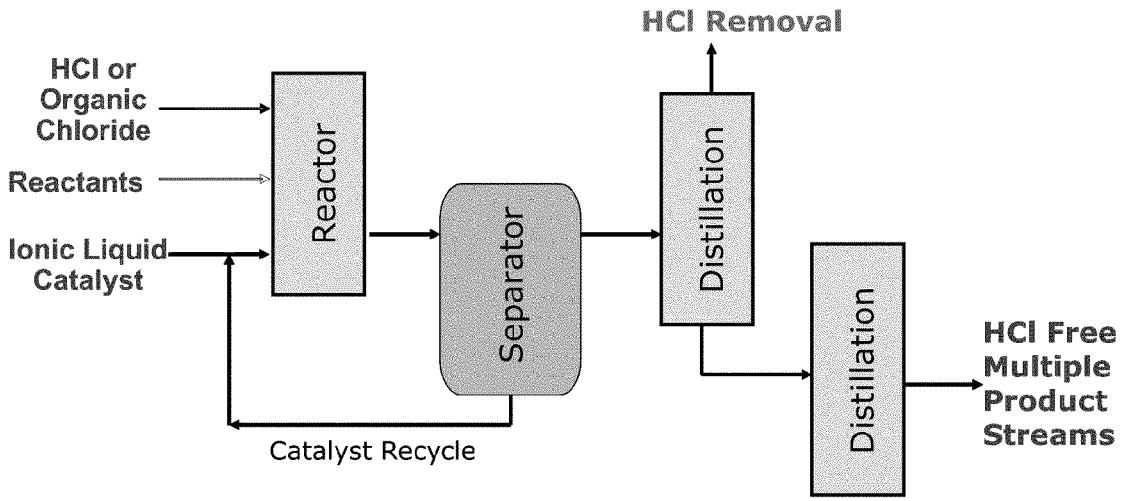
FIG. 1 is a process flow diagram of an embodiment showing removal of HCl in a hydrocarbon process stream.

Hydrogen halides are acids resulting from the chemical reaction of hydrogen with one of the halogen elements (fluorine, chlorine, bromine, iodine, astatine and ununseptium), which are found in Group 17 of the periodic table. Astatine is not included in the list because it is very rare, unstable and not found as the acid in substantial quantities. Hydrogen halides can be abbreviated as HX where H represents a hydrogen atom and X represents a halogen (fluorine, chlorine, bromine or iodine). The boiling points of the most common hydrogen halides are listed below:

| | |
|---|---|
| HF | 19° C. |
| HCl | −85° C. |
| HBr | −67° C. |
| HI | −35° C. |

Because of their relatively low boiling points, hydrogen halides are compounds that can be separated from other hydrocarbons by distilling or stripping. It is desired that levels of hydrogen halides be kept at a minimum in many finished products.

In the context of this disclosure, 'an increased amount' is at least 5 ppm higher than an initial amount. 'A reduced amount' is at least 5 ppm lower than an initial amount.

Stripping is the removal of volatile components from a liquid by vaporization. In stripping processes, the solution from the separation step must be stripped in order to permit recovery of the separated hydrocarbons and recycle of the lighter gases. Stripping may be accomplished by pressure reduction, the application of heat, or the use of an inert gas or hydrogen gas (stripping vapor). Some processes may employ a combination of all three; that is, after separation, the hydrocarbon products are flashed to atmospheric pressure, heated, and admitted into a stripping column which is provided with a bottom heater (reboiler). Solvent vapor generated in the reboiler or inert gas injected at the bottom of the column serves as stripping vapor which rises counter currently to the down flowing of hydrocarbon products.

Distilling is the extraction of the volatile components of a mixture by the condensation and collection of the vapors that are produced as the mixture is heated. Distilling is described in Section 13 of *Perry's Chemical Engineer's Handbook* (8$^{th}$ *Edition*), by Don W. Green and Robert H. Perry, © 2008 McGraw-Hill, pages 13-1 to 13-79. In one embodiment the distilling is performed in a distillation column with a bottom temperature and an overhead temperature selected such that the second fraction has less than 25 wppm of the hydrogen halide. In one embodiment the distillation is performed in a distillation column at a pressure between 50 and 500 psig. In one embodiment, the bottom temperature in a distillation column is between 50 and 400° F. In one embodiment, the overhead temperature in a distillation column is between 100 and 600° F. In one embodiment, the distillation is performed with reflux. Reflux is a technique, using a reflux condenser, allowing one to boil the contents of a vessel over an extended period. The distillation conditions are selected to provide the first fraction having an increased amount of the hydrogen halide and the second fraction having a reduced amount of the hydrogen halide. The distillation conditions are adjusted to obtain desired levels of hydrogen halide in each fraction. One example is where the distilling is performed in a distillation column at a pressure between 50 and 500 psig, a bottom temperature between 10 and 204° C. (50 and 400° F.), an overhead temperature between 38 and 316° C. (100 and 600° F.), and with reflux; such that the second fraction has less than 25 wpm of the hydrogen halide and the first fraction has at least 5 wt % of the hydrogen halide.

For maximum recovery of the hydrogen halide, distilling would more likely be employed. If maximum recovery of the hydrogen halide is not as critical, then stripping might be more desirable, to lower the equipment cost.

In one embodiment, the level of hydrogen halide in the first fraction is at least 5 wt %. In another embodiment, the second fraction has less than 25 wppm hydrogen halide. In other embodiments, the second fraction has less than 20 wppm hydrogen halide, less than 15 wppm hydrogen halide, less than 10 wppm hydrogen halide, less than 5 wppm hydrogen halide, or less than 1 wppm hydrogen halide.

The reactor may be any design suitable for achieving a desired hydrocarbon conversion. Examples of hydrogen conversions for which the reactor is used for include paraffin alkylation, olefin dimerization, olefin oligomerization, isomerization, aromatic alkylation, and mixtures thereof. Examples of reactors include stirred tank reactors, which can be either a batch reactor or a continuously stirred tank reactor (CSTR). Alternatively, a batch reactor, a semi-batch reactor, a riser reactor, a tubular reactor, a loop reactor, a continuous reactor, a static mixer, a packed bed contactor, or any other reactor and combinations of two or more thereof can be employed. Specific examples of alkylation reactors comprising ionic liquid catalysts that are useful for paraffin alkylation are described in US 2009-0166257 A1, US 2009-0171134 A1, and US 2009-0171133 A1.

In one embodiment the reactor comprises an ionic liquid catalyst having a metal halide, and a hydrogen halide or an organic halide. In another embodiment the reactor comprises an ionic liquid catalyst having a metal halide. Examples of metal halides are $AlCl_3$, $AlBr_3$, $GaCl_3$, $GaBr_3$, $InCl_3$, $InBr_3$, and mixtures thereof. In one embodiment the hydrogen halide is anhydrous HCl. In one embodiment the metal halide is aluminum chloride and the hydrogen halide is hydrogen chloride (HCl). In some embodiments, excess amounts of anhydrous HCl are needed to ensure extended operation of a catalytic process.

The effluent from the reactor comprises a level of hydrogen halide that is higher than what is desired in a product stream. The hydrogen halide is derived from one or more of the metal halide, the hydrogen halide, or the organic halide that may be present in the reactor.

The process comprises recycling at least a portion of the first fraction to the reactor. In one embodiment, the at least a portion of the first fraction comprises at least 5 wt % of the hydrogen halide. In another embodiment, the at least a portion of the first fraction comprises at least 5 wt % and less than 95 wt % of the hydrogen halide. In another embodiment, the at least a portion of the first fraction comprises from at least 10 wt % to less than 45 wt % or 30 wt % of the hydrogen halide, such as from 10 wt % to less than 20 wt % of the hydrogen halide. The level of hydrogen halide can be adjusted and selected to improve the selectivity of the products from the reactor to alkylate gasoline or middle distillate. A process for producing alkylate gasoline and a middle distillate, comprising: (a) adjusting a level of a halide containing additive provided to an ionic liquid alkylation reactor to shift selectivity towards heavier products in an alkylate product; and (b) recovering from the alkylate product: (i) the gasoline blending component that is a low volatility gasoline blending component; and (ii) the middle distillate, is taught in U.S. patent application Ser. No. 12/184,109, filed Jul. 31, 2008.

In one embodiment, the process additionally includes recovering one or more product streams that have an acceptable level of hydrogen halide from the second fraction. In one embodiment, the process additionally comprises recovering an alkylate gasoline having less than 5 wppm hydrogen halide from the second fraction. In some embodiments the one or more product streams have less than 25 wppm of the hydrogen halide. In other embodiments they have less than 20, less than 10, less than 5, less than 2, or less than 1 wppm of the hydrogen halide. In some embodiments, the one or more product streams have less than 25 wppm, less than 20, less than 10, less than 5, less than 2, or even less than 1 wppm of the hydrogen halide prior to any optional caustic treating. Because the one or more product streams have such low amounts of hydrogen halide, little to no caustic treating of the products is needed, which reduces process complexity and cost.

In one embodiment the one or more product streams comprise a propane, n-butane, and an alkylate gasoline; and all of them have less than 25 wppm of the hydrogen halide. In other embodiments, all of them have less than 10 wppm, less than 5 wppm, less than 2 wppm, or less than 1 wppm. Alkylate gasoline is the isoparaffin reaction product of butylene or propylene or ethylene or pentene with isobutane, or the isoparaffin reaction product of ethylene or propylene or butylenes with isopentane. In some embodiments the alkylate gasoline has high octane value and can be blended with motor and aviation gasoline to improve the antiknock value of the fuel.

In one embodiment, an alkylate gasoline having less than 5 wppm hydrogen halide is recovered from the second fraction. No further processing of the alkylate gasoline is required to obtain this low level of hydrogen halide. In other embodiments, the alkylate gasoline that is recovered directly from the second fraction has less than 2 wppm or less than 1 wppm hydrogen halide.

The ionic liquid catalyst is composed of at least two components which form a complex. The ionic liquid catalyst comprises a first component and a second component. The first component of the catalyst may comprise a Lewis Acid selected from components such as Lewis Acidic compounds of Group 13 metals, including aluminum halides, alkyl aluminum halide, gallium halide, and alkyl gallium halide (see International Union of Pure and Applied Chemistry (IUPAC), version3, October 2005, for Group 13 metals of the periodic table). Other Lewis Acidic compounds in addition to those of Group 13 metals may also be used. In one embodiment the first component is aluminum halide or alkyl aluminum halide. For example, aluminum trichloride may be the first component of the acidic ionic liquid catalyst.

The second component making up the acidic ionic liquid catalyst is an organic salt or mixture of salts. These salts may be characterized by the general formula Q+A−, wherein Q+ is an ammonium, phosphonium, boronium, iodonium, or sulfonium cation and A− is a negatively charged ion such as $Cl^-$, $Br^-$, $ClO_4^-$, $NO_3^-$, $BF_4^-$, $BCl_4^-$, $PF_6^-$, $SbF_6^-$, $AlCl_4^-$, $TaF_6^-$, $CuCl_2^-$, $FeCl_3^-$, $HSO_3^-$, $RSO_3^-$, $SO_3CF_3^-$, and 3-sulfurtrioxyphenyl. In one embodiment the second component is selected from those having quaternary ammonium halides containing one or more alkyl moieties having from about 1 to about 12 carbon atoms, such as, for example, trimethylamine hydrochloride, methyltributylammonium halide, or substituted heterocyclic ammonium halide compounds, such as hydrocarbyl substituted pyridinium halide compounds, such as, for example, 1-butylpyridinium halide, benzylpyridinium halide, or hydrocarbyl substituted imidazolium halides, such as for example, 1-ethyl-3-methyl-imidazolium chloride.

In one embodiment the ionic liquid catalyst is selected from the group consisting of hydrocarbyl substituted pyridinium chloroaluminate, hydrocarbyl substituted imidazolium chloroaluminate, quaternary amine chloroaluminate, trialky amine hydrogen chloride chloroaluminate, alkyl pyridine hydrogen chloride chloroaluminate, and mixtures thereof. For example, the ionic liquid catalyst can be an acidic haloaluminate ionic liquid, such as an alkyl substituted pyridinium chloroaluminate or an alkyl substituted imidazolium chloroaluminate of the general formulas A and B, respectively.

A

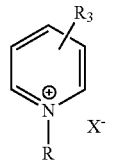

B

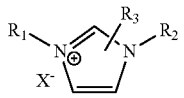

In the formulas A and B; R, $R_1$, $R_2$, and $R_3$ are H, methyl, ethyl, propyl, butyl, pentyl or hexyl group, X is a chloroaluminate. In the formulas A and B, R, $R_1$, $R_2$, and $R_3$ may or may not be the same. In one embodiment the ionic liquid catalyst is N-butylpyridinium chloroaluminate.

In another embodiment the ionic liquid catalyst can have the general formula $RR'R''NH^+Al_2Cl_7^-$, wherein N is a nitrogen containing group, and wherein RR' and R" are alkyl groups containing 1 to 12 carbons, and where RR' and R" may or may not be the same.

The presence of the first component should give the ionic liquid a Lewis or Franklin acidic character. Generally, the greater the mole ratio of the first component to the second component, the greater is the acidity of the ionic liquid catalyst.

In one embodiment, the ionic liquid catalyst is mixed in the reactor with a hydrogen halide or an organic halide. The hydrogen halide or organic halide can boost the overall acidity and change the selectivity of the ionic liquid catalyst. The organic halide may be an alkyl halide. The alkyl halides that may be used include alkyl bromides, alkyl chlorides, alkyl iodides, and mixtures thereof. A variety of alkyl halides may be used. Alkyl halide derivatives of the isoparaffins or the olefins that comprise the feed streams in the alkylation process are good choices. Such alkyl halides include, but are not limited to, iospentyl halides, isobutyl halides, butyl halides, propyl halides and ethyl halides. Other alkyl chlorides or halides having from 1 to 8 carbon atoms may be also used. The alkyl halides may be used alone or in combination. The use of alkyl halides to promote hydrocarbon conversion by ionic liquid catalysts is taught in U.S. Pat. No. 7,495,144 and in U.S. patent application Ser. No. 12/468,750, filed May 19, 2009.

It is believed that the alkyl halide decomposes under hydroconversion conditions to liberate Broensted acids or hydrogen halides, such as hydrochloric acid (HCl) or hydrobromic acid (HBr). These Broensted acids or hydrogen halides promote the hydrocarbon conversion reaction. In one embodiment the halide in the hydrogen halide or alkyl halide is the same as a halide component of the ionic liquid catalyst. In one embodiment the alkyl halide is an alkyl chloride. A hydrogen chloride or an alkyl chloride may be used advantageously, for example, when the ionic liquid catalyst is a chloroaluminate.

In one embodiment, at least a portion of the first fraction having an increased amount of the hydrogen halide is recycled back to the reactor. By recycling the hydrogen halide, less (or no) additional hydrogen halide or organic halide is required to be fed to the reactor. In one embodiment, the at least a portion of the first fraction is the full portion. For example, the process can comprise recycling all of the first fraction to the reactor. By recycling the full portion, less piping and equipment is needed. In one embodiment, the recycling enhances the activity of the ionic liquid catalyst for the hydrocarbon conversion. The hydrocarbon conversion may be selected from the group consisting of paraffin alkylation, olefin dimerization, olefin oligomerization, isomerization, aromatic alkylation, and mixtures thereof.

In one embodiment, the one or more product streams or a portion of the second fraction comprise one or more isoparaffins that are recycled back to the reactor. The isoparaffins may be the same as the reactants that were originally fed to the reactor. Processes for recycling isoparaffin to a reactor comprising an ionic liquid catalyst is described in US Patent Publication US20090171133. Among other factors, recycling of isoparaffins to the reactor provides a more efficient alkylation and/or oligomerization process when using an ionic liquid catalyst. The recycling of isoparaffins allows the reaction in the presence of the ionic liquid catalyst to maintain a more effective ratio of isoparaffin to olefin (I/O). Having the correct I/O is essential to minimize undesired side reactions. One can also use a lower quality of feed while maintaining a desired I/O within the reactor.

In one embodiment, the distilling or stripping are anhydrous, which provides one or more dry isoparaffins that require no further drying before recycling to the reactor. For example the anhydrous operation of the distillation column may provide a dry isobutane that is recycled back to an alkylation reactor.

In one embodiment, the effluent from the reactor is separated into a hydrocarbon phase and a catalyst phase, and the stripping or distilling is performed on the hydrocarbon phase.

The stripping or distilling of the effluent may be done once or in a series of stripping or distilling steps. The costs of equipment and energy are reduced in the embodiment where the stripping or distilling is only done once.

In one embodiment, the recovering is done in process equipment made with one or more metals that have poor corrosion resistance to HCl and wherein the process equipment does not exhibit corrosion from the recovering. Examples of process equipment that may be used for recovering include strippers, flash drums, distillation columns, piping, valves, trays, plates, random or structured packings, coalescers, screens, filters, fractionators, dividing walls, absorbers, etc. Metals that have poor corrosion resistance to HCl include aluminum, carbon steel, cast iron, stainless steel, bronze, and Durimet® alloys. These metals are less expensive and more readily available than metals that have better corrosion resistance to HCl, such as Hastelloy® alloys, Monel® alloys, Carpenter® alloys, tantalum, titanium, or cobalt-based alloys. DURIMET is a registered trademark of Flowserve Corporation. HASTELLOY is a registered trade name of Haynes International, Inc. MONEL is a registered trade name of the INCO family of companies. CARPENTER is a registered trade name of Carpenter Technology Corporation. Information on materials that are more or less resistant to corrosion by HCl are described in the *Kirk-Othmer Encyclopedia of Chemical Technology* (John Wiley & Sons, Inc.), DOI: 10.1002/0471238961.0825041808091908.a01.pub2. Article Online Posting Date: Dec. 17, 2004.

In one embodiment the recovering uses a distillation column made with one or more metals having poor corrosion resistance to the hydrogen halide, and the distillation column does not exhibit corrosion from the recovering. Examples of these metals are carbon steel, stainless steel, and mixtures thereof. Evidence of when the distillation column or process equipment do not exhibit corrosion are when the metal penetration is less than 10 mil/year, where 1 mil=0.001 inch. In one embodiment the process equipment has less than 10 mil/year penetration.

The hydrogen halide concentration in the one or more product streams, the first fraction, the second fraction, or portions thereof can be measured by any method that is accurate in the range of the concentration of the hydrogen halide. For gas streams, the following test methods are appropriate: (1) using a DRAEGER TUBE™ with a pre-calibrated hydrogen halide selective probe, (2) using an on-line hydrogen halide measurement device, or (3) via acid/base titration with a standard caustic solution with a known concentration. DRAEGER TUBE™ is a registered trademark of Draeger Safety Inc. For liquid streams the hydrogen halide can be measured by titration using a standard caustic solution with a known concentration.

The following is a description of an embodiment of the application with reference to FIG. 1:

Hydrogen chloride or organic chloride, reactants, and an ionic liquid catalyst are fed to a reactor. Effluents from the reactor are passed through a separator, which separates the effluent into a hydrocarbon phase and a catalyst phase. At least a portion of the catalyst phase is recycled back to the ionic liquid catalyst being fed to the reactor. At least a portion of the hydrocarbon phase is fed to a distillation column. The distillation column distills the effluent from the reactor into a first fraction having essentially all of the hydrogen chloride and a second fraction that has essentially no hydrogen chloride. The second fraction is then further distilled to recover multiple product streams that are free of hydrogen chloride.

Figure 2:
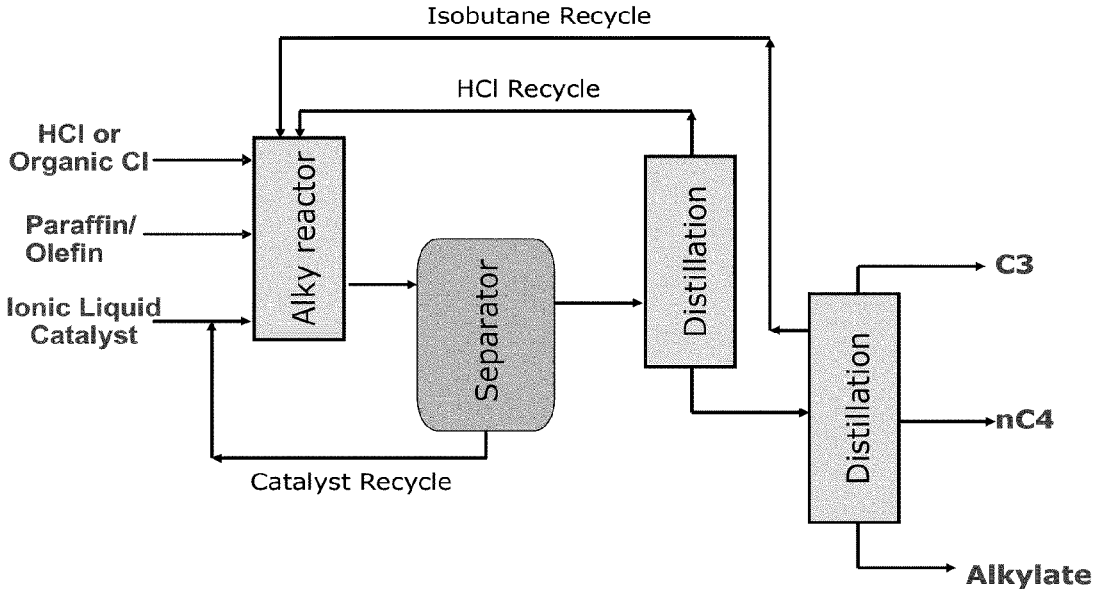
FIG. 2 is a process flow diagram of an embodiment showing recycling of anhydrous HCl and anhydrous isobutane for paraffin alkylation.

The following is a description of an embodiment of the application with reference to FIG. 2:

Hydrogen chloride or organic chloride, reactants comprising one or more paraffins and one or more olefins, and an ionic liquid catalyst are fed to an alkylation reactor. Effluents from the alkylation reactor are passed through a separator, which separates the effluent into a hydrocarbon phase and a catalyst phase. At least a portion of the catalyst phase is recycled back to the ionic liquid catalyst being fed to the alkylation reactor. At least a portion of the hydrocarbon phase is fed to a distillation column. The distillation column distills the effluent from the reactor into a first fraction having essentially all of the hydrogen chloride and a second fraction that has essentially no hydrogen chloride. At least a portion of the first fraction is fed back to the alkylation reactor. The second fraction is then further distilled to recover multiple product streams that are free of hydrogen chloride, and an anhydrous isobutane stream that is recycled back to the alkylation reactor. The multiple product streams that are free of hydrogen chloride comprise propane, n-butane, and alkylate gasoline.

For the purposes of this specification and appended claims, unless otherwise indicated, all numbers expressing quantities, percentages or proportions, and other numerical values used in the specification and claims, are to be understood as being modified in all instances by the term "about." Furthermore, all ranges disclosed herein are inclusive of the endpoints and are independently combinable. Whenever a numerical range with a lower limit and an upper limit are disclosed, any number falling within the range is also specifically disclosed.

Any term, abbreviation or shorthand not defined is understood to have the ordinary meaning used by a person skilled in the art at the time the application is filed. The singular forms "a," "an," and "the," include plural references unless expressly and unequivocally limited to one instance.

All of the publications, patents and patent applications cited in this application are herein incorporated by reference in their entirety to the same extent as if the disclosure of each individual publication, patent application or patent was specifically and individually indicated to be incorporated by reference in its entirety.

This written description uses examples to disclose the invention, including the best mode, and also to enable any person skilled in the art to make and use the invention. Many modifications of the exemplary embodiments of the invention disclosed above will readily occur to those skilled in the art. Accordingly, the invention is to be construed as including all structure and methods that fall within the scope of the appended claims. Unless otherwise specified, the recitation of a genus of elements, materials or other components, from which an individual component or mixture of components can be selected, is intended to include all possible sub-generic combinations of the listed components and mixtures thereof.

EXAMPLES

Example 1

A sample of N-butylpyridinium chloroaluminate ($C_5H_5C_4H_9Al_2Cl_7$) ionic liquid catalyst was analyzed and had the following elemental composition. The ionic liquid catalyst had aluminum chloride as the metal halide.

| | |
|---|---|
| Wt % Al | 12.4 |
| Wt % Cl | 56.5 |
| Wt % C | 24.6 |
| Wt % H | 3.2 |
| Wt % N | 3.3 |

Example 2

The ionic liquid catalyst described in Example 1 was used to alkylate $C_3$ and $C_4$ olefins with isobutane. The alkylation was performed in a continuously stirred tank reactor (CSTR). An 8:1 molar ratio of isobutane to total olefin mixture was fed to the reactor via a first inlet port while vigorously stirring. The ionic liquid catalyst was fed to the reactor via a second inlet port, targeting to occupy 7 vol % in the reactor. A small amount of anhydrous HCl gas, 20:1 molar ratio of olefin to HCl, was added to the ionic liquid catalyst in the reactor. The average residence time of the combined feeds (isobutane/olefin mixture and catalyst) in the reactor was about eight minutes. The outlet pressure was maintained at 200 psig and the reactor temperature was maintained at 15.6° C. (60° F.) using external cooling. The reactor effluent was separated with a gravity separator into a hydrocarbon phase and an ionic liquid catalyst phase.

The separated hydrocarbon phase was sent to a distillation column operating at 245 psig, 99° C. (210° F.) bottom temperature and 49° C. (120° F.) overhead temperature, with reflux. The overhead stream was rich in HCl, up to 15 wt % HCl, and the remainder was mainly propane. The HCl-rich overhead stream was sent back to the reactor for further use. The bottom stream was nearly HCl-free, showing less than a 10 ppm HCl concentration. The essentially HCl-free hydrocarbon bottom stream was sent to further distillation to generate an isobutane recycle stream as well as propane, n-butane, and alkylate gasoline product streams. The propane, n-butane, and alkylate gasoline product streams contained no measurable HCl, showing less than 5 ppm HCl.

This process scheme is desirable since HCl is concentrated only for the 1st distillation column, thus any corrosion concerns for the subsequent distillation columns are eliminated. By recycling the HCl enriched propane stream back to the reactor, the HCl material cost and handling hazards are minimized.

Example 3

Comparative Example, Reduction of HCl Using Caustic Treating

Reactor effluent from Example 2 was treated with 8 wt % NaOH caustic solution in a stirred tank reactor at process conditions of 3:1 hydrocarbon to caustic solution volume ratio, room temperature (60° F.), 15 minute average residence time and vigorous stirring. The resulting hydrocarbon and caustic solution mixture was then separated by gravity in a settler. The hydrocarbon phase was sent to the distillation column to produce propane, n-butane and alkylate gasoline product streams and isobutane recycle stream. All these streams contained no measurable HCl, showing less than 5 ppm HCl. However, with this process the HCl is consumed and cannot be recycled back to the reactor. Also the isobutane recycle stream is now saturated with water, thus needing thorough drying before sending back to the reactor for reuse. These additional steps may make the process operation more costly, and also there are corrosion concerns for the caustic treatment equipment.

Example 4

Recycle of HCl Using Cascade Distillation

Reactor effluent from Example 2 was sent to a series of distillation columns to separate the hydrocarbon streams first. The distillation columns operated at 38-149° C. (100-300° F.) bottom temperatures, 10-93° C. (50-200° F.) overhead temperatures, and 100-200 psig pressure. The resulting alkylate stream contained no measurable HCl, showing less than 5 ppm HCl. The butane stream also contained no measurable HCl, showing less than 5 ppm HCl. The recycle isobutane stream contained some HCl up to a few hundred ppm depending on the operating conditions. The propane stream was enriched with over 1000 ppm HCl. By adding another distillation column for the propane stream, the HCl was enriched in the overhead to around 15 wt % HCl and the remainder was mainly propane. This HCl enriched stream is recycled back to the reactor. This HCl and isobutane recycle process is workable. However, all distillation columns are now exposed to HCl gas and this generates concerns for corrosion.

It is claimed:

1. A process for hydrocarbon conversion, comprising:

a) distilling a hydrocarbon effluent, from a reactor comprising an ionic liquid catalyst having: a metal halide, and a hydrogen halide or an organic halide, into:
   i. a first fraction comprising propane, and having an amount of a hydrogen halide, and
   ii. a second fraction having less than 25 wppm of the hydrogen halide;

b) recycling at least a portion of the first fraction, wherein the at least a portion comprises at least 5 wt % and less than 95 wt % of the hydrogen halide, to the reactor; wherein the reactor conducts a hydrocarbon conversion selected from the group consisting of paraffin alkylation, olefin dimerization, olefin oligomerization, aromatic alkylation, and mixtures thereof; and c) recovering a propane, a n-butane, and an alkylate gasoline, directly from the second fraction, all having less than 25 wppm of the hydrogen halide.

2. The process of claim 1, additionally comprising the step of separating a catalyst phase from the effluent before stripping or distilling the effluent.

3. The process of claim 1, comprising recycling all of the first fraction to the reactor.

4. The process of claim 1, wherein the at least a portion of the first fraction comprises from at least 10 wt % to less than 30 wt % of the hydrogen halide.

5. The process of claim 1, wherein the metal halide is aluminum chloride.

6. The process of claim 1, wherein the organic halide has from 1 to 8 carbon atoms.

7. The process of claim 1, wherein the organic halide comprises an alkyl chloride.

8. The process of claim 1, wherein the hydrogen halide is hydrogen chloride.

9. The process of claim 1, wherein the ionic liquid catalyst is selected from the group consisting of hydrocarbyl substituted pyridinium chloroaluminate, hydrocarbyl substituted imidazolium chloroaluminate, quaternary amine chloroaluminate, trialky amine hydrogen chloride chloroaluminate, alkyl pyridine hydrogen chloride chloroaluminate, and mixtures thereof.

10. The process of claim 9, wherein the ionic liquid catalyst is N-butylpyridinium chloroaluminate.

11. The process of claim 1, wherein the reactor conducts a hydrocarbon conversion selected from the group consisting of paraffin alkylation, olefin dimerization, olefin oligomerization, and mixtures thereof.

12. The process of claim 1, wherein the distilling is performed in a distillation column with a bottom temperature and an overhead temperature selected such that the second fraction has less than 20 wppm of the hydrogen halide.

13. The process of claim 1, wherein the distilling is performed in a distillation column or a series of distillation columns at a pressure between 50 and 500 psig, a bottom temperature between 10 and 204° C. (50 and 400° F.), an overhead temperature between 10 and 316° C. (50 and 600° F.), and with reflux; such that the first fraction has at least 5 wt % of the hydrogen halide.

14. A process for hydrocarbon conversion, comprising:

a) separating an effluent from a reactor comprising an ionic liquid catalyst, a metal halide, and a hydrogen halide or an organic halide into a hydrocarbon phase and a catalyst phase;

b) recycling at least a portion of the catalyst phase back to the reactor;

c) distilling the hydrocarbon phase into a first fraction having greater than 5 wt % of the hydrogen halide and a second fraction having less than 25 wppm of the hydrogen halide;

d) recycling at least a portion of the first fraction, wherein the at least a portion comprises at least 5 wt % and less than 95 wt % of the hydrogen halide, to the reactor;

e) recycling a portion of the second fraction, that comprises one or more isoparaffins, to the reactor; and f) recovering a propane, a n-butane, and an alkylate gasoline, all having less than 5 wppm hydrogen halide, directly from the second fraction.

15. The process of claim 14, wherein the reactor is an alkylation reactor.

16. The process of claim 14, additionally comprising recovering an alkylate gasoline having less than 1 wppm hydrogen halide directly from the second fraction.

17. The process of claim 1, wherein the distilling is performed in a distillation column or a series of distillation columns at a bottom temperature between 50° F. (10 degree Celsius) and 300° F. (148.9 degree Celsius).

18. The process of claim 14, wherein the distilling is performed in a distillation column or series of distillation columns at a bottom temperature between 50° F. (10 degree Celsius) and 300° F. (148.9 degree Celsius).

* * * * *